US007817008B2

(12) United States Patent
Lee et al.

(10) Patent No.: US 7,817,008 B2
(45) Date of Patent: Oct. 19, 2010

(54) MAGNETIC ELEMENT

(75) Inventors: Cheng-Hong Lee, Taoyuan Hsien (TW); Chih-Hung Chang, Taoyuan Hsien (TW); Yi-Hong Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/248,518

(22) Filed: Oct. 9, 2008

(65) Prior Publication Data

US 2010/0052835 A1 Mar. 4, 2010

(30) Foreign Application Priority Data

Sep. 4, 2008 (TW) ..... 97133840 A

(51) Int. Cl.
*H01F 5/00* (2006.01)

(52) U.S. Cl. ..... 336/200

(58) Field of Classification Search ..... 336/65, 336/83, 200, 232, 233
See application file for complete search history.

(56) References Cited

U.S. PATENT DOCUMENTS

| | | | | |
|---|---|---|---|---|
| 7,078,999 | B2 * | 7/2006 | Uriu et al. | 336/200 |
| 2003/0137384 | A1 * | 7/2003 | Itou et al. | 336/200 |
| 2005/0195062 | A1 * | 9/2005 | Yoshida et al. | 336/200 |

* cited by examiner

*Primary Examiner*—Tuyen Nguyen
(74) *Attorney, Agent, or Firm*—Muncy, Geissler, Olds & Lowe, PLLC

(57) ABSTRACT

A magnetic element includes a pair of coil sets. Each of the coil sets includes a first coil having a plurality of first metallic lines, a second coil having a plurality of second metallic lines, and at least one conductive column electrically connected between the first coil and the second coil. The magnetic element further includes a package body for enclosing the pair of coil sets therein.

20 Claims, 8 Drawing Sheets

MAGNETIC ELEMENT

CROSS REFERENCE TO RELATED APPLICATIONS

This Non-provisional application claims priority under 35 U.S.C. §119(a) on Patent Application No(s). 097133840 filed in Taiwan, Republic of China on Sep. 4, 2008, the entire contents of which are hereby incorporated by reference.

BACKGROUND OF THE INVENTION

1. Field of Invention

The present invention relates to a magnetic element and, in particular, to a filter that is capable of eliminating the common-mode noise.

2. Related Art

The applications of the present electronic circuits have been widely spread. These kinds of electronic circuits are usually operated at high frequency, which can easily generate the electro magnetic interference (EMI). The high frequency noise can be transmitted by electromagnetic radiation or power line conduction so as to interfere the normal operation of other electronic apparatuses. The conduction EMI can be divided, according to the noise current paths, to the differential-mode (DM) noise and the common-mode (CM) noise.

In order to efficiently eliminate the EMI, the filter, which is corresponding to the type of the noise to be eliminated, is usually configured in the electronic device. For example, to eliminate the CM noise, the electronic device can be configured with a filter for eliminating the CM noise. The filter can be formed by stacking a plurality of metal coil layers and independent insulating layers. However, the properties of the filter, such as the bandwidth or the inductance value, are closely related to the layout design of the metal coil layers. The bandwidth or inductance value of the conventional filter is restricted due to the space limitation.

SUMMARY OF THE INVENTION

In view of the foregoing, the present invention is to provide a magnetic element that has larger bandwidth and can efficiently eliminate the noise.

To achieve the above, the present invention discloses a magnetic element including a pair of coil sets and a package body. Each of the coil sets includes a first coil, a second coil and at least one conductive column. The first coil has a plurality of first metallic lines, and the second coil has a plurality of second metallic lines. The conductive column is electrically connected between the first and second coils. The package body encloses the pair of coil sets therein.

The first and second coils have a spiral distribution in a projecting direction. The first or second metallic lines are aligned on the same plane in another projecting direction.

Preferably, the first metallic lines and a part of the second metallic lines are overlapped in the projecting direction. Alternatively, the first and second metallic lines are totally overlapped in the projecting direction. Probably, the first and second metallic lines are not overlapped in the projecting direction. In addition, the first and second metallic lines are partially overlapped in the projecting direction.

Preferably, the thicknesses of the first and second coils range between 9 to 11 μm. In addition, an interval between the metallic lines ranges between 30 to 60 μm, and the width of the metallic lines ranges between 10 to 15 μm.

In addition, the package body further includes a first magnetic substrate, a second magnetic substrate and an intermediate layer. The second magnetic substrate is disposed opposite to the first magnetic substrate. The intermediate layer is disposed between the first and second magnetic substrates, and the coil sets are disposed in the intermediate layer.

The intermediate layer includes at least one dielectric layer or insulating layer and has at least one through hole. A magnetic material is filled in the through hole or a side area of the magnetic element. The magnetic material includes a magnetic power and a resin.

Alternatively, the intermediate layer can include a single or multiple dielectric layers or insulating layers. The thickness of each of the dielectric layers or insulating layers ranges between 4 to 20 μm.

The pair of coil sets and the first or second magnetic substrates are separated by an insulating layer or a dielectric layer.

The magnetic element further includes a first electrode electrically connected to one of the first metallic lines and a second electrode electrically connected to one of the second metallic lines. One end of the first electrode connected to the first metallic line and one end of the second electrode connected to the second metallic line are extended to opposite or the same direction. The second electrode is electrically connected to one of the second metallic lines disposed at the inner side of the second coil.

In addition, the magnetic element further includes a plurality of external electrodes electrically connected to the first and second electrodes. The external electrode is formed by sputtering and electroplating.

The pair of coil sets are separated by an insulating layer or a dielectric layer.

Preferably, the magnetic element is a filter for eliminating the common-mode (CM) noise.

To achieve the above, the present invention also discloses a magnetic element, which includes a first coil, a second coil and at least one conductive column. The first coil has a plurality of first metallic lines, and the second coil has a plurality of second metallic lines. The conductive column is connected between the first and second coils. The first and second coils have a spiral distribution. The first and second metallic lines are partially overlapped, totally overlapped or not overlapped in a projecting direction.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
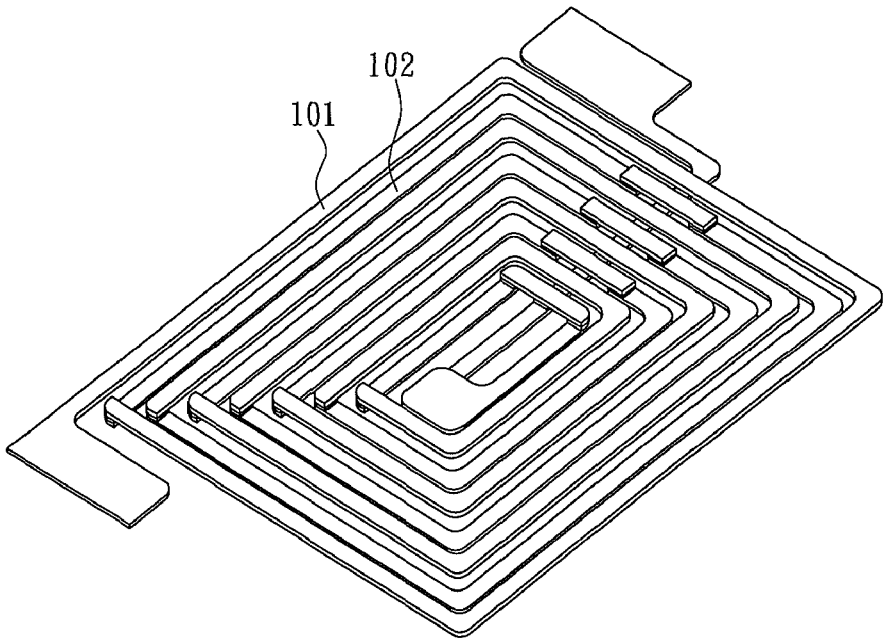
FIG. 1A is a schematic illustration showing a distribution of the coil set of a magnetic element according to an embodiment of the present invention.
Figure 1B:
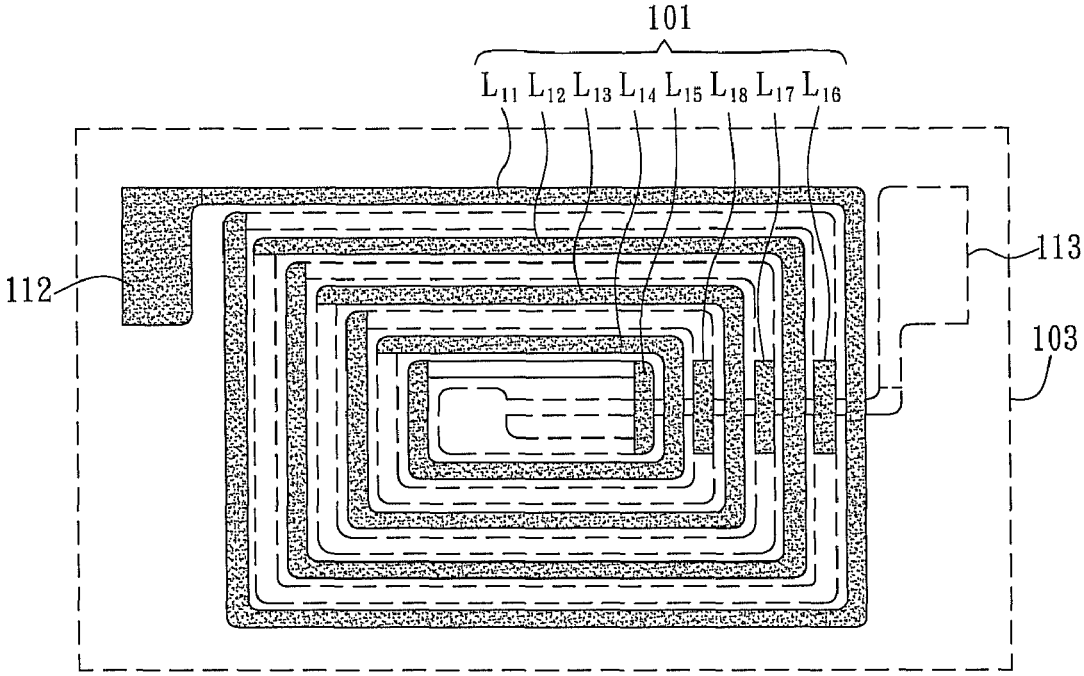
FIG. 1B is a schematic illustration of the first coil in FIG. 1A.
Figure 1C:
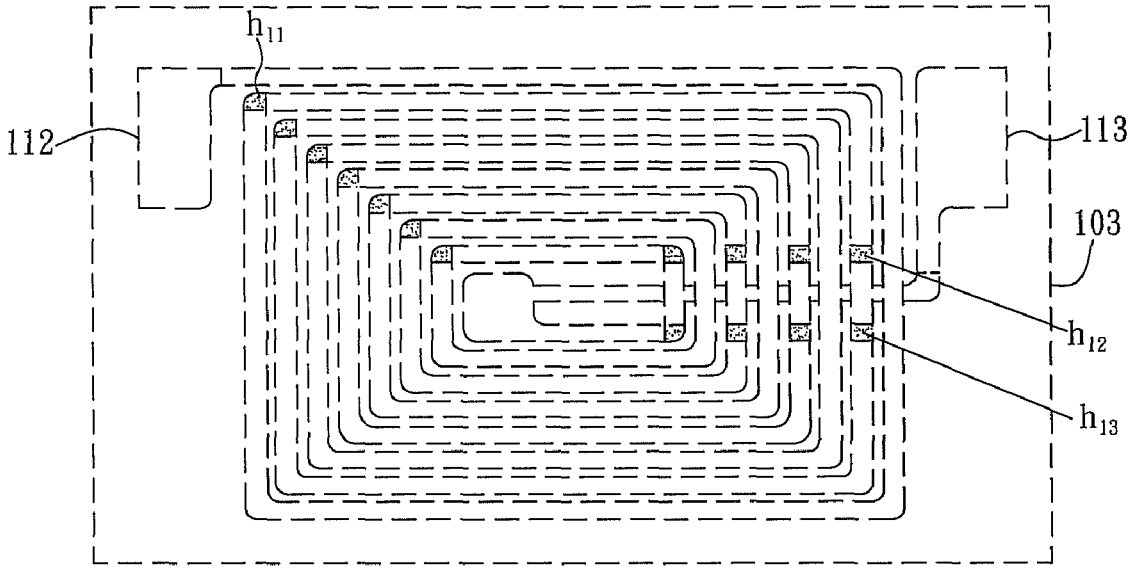
FIG. 1C is a schematic illustration showing the configuration of the conductive column for connecting the first coil and the second coil.
Figure 1D:
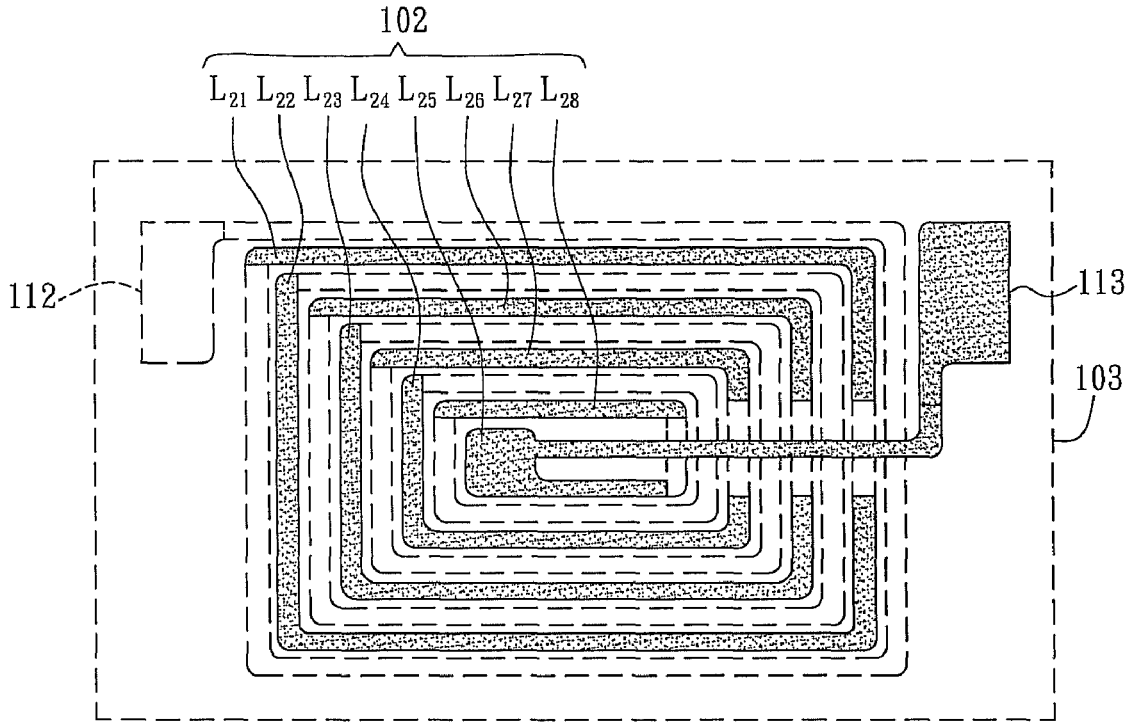
FIG. 1D is a schematic illustration showing the distribution of the second coil in FIG. 1A.

Please refer to FIGS. 1A to 1D. FIG. 1A is a schematic illustration showing a distribution of the coil set of a magnetic element according to an embodiment of the present invention. The magnetic element of the present invention includes a pair of coil sets, each of which includes a first coil 101 and a second coil 102 as shown in FIG. 1A. FIG. 1B is a schematic illustration of the first coil 101 in FIG. 1A. FIG. 1D is a schematic illustration showing the distribution of the second coil 102 in FIG. 1A. FIG. 1C is a schematic illustration showing the configuration of the conductive column for connecting the first and second coils.

As shown in FIGS. 1B and 1D, the first coil 101 has a plurality of first metallic lines $L_{11}$ to $L_{18}$, and the second coil 102 has a plurality of second metallic lines $L_{21}$ to $L_{28}$. Of course, the number of the first and second metallic lines can be adjusted according to the actual need.

The connections between the first metallic lines $L_{11}$ to $L_{18}$ and the second metallic lines $L_{21}$ to $L_{28}$ will be described hereinbelow. Referring to FIGS. 1B, 1C and 1D, the first metallic line $L_{11}$ is electrically connected to one end of the second metallic line $L_{21}$ through a conductive column $h_{11}$, the other end of the second metallic line $L_{21}$ is electrically connected to one end of the first metallic line $L_{16}$ through a conductive column $h_{12}$, and the other end of the first metallic line $L_{16}$ is electrically connected to one end of the second metallic line $L_{22}$ through a conductive column $h_{13}$. The rest connections between the first and second metallic lines may be deduced by analogy so that the coil set has a spiral distribution.

As shown in FIGS. 1A to 1D, the first metallic lines $L_{11}$ to $L_{18}$ of the first coil 101 and the second metallic lines $L_{21}$ to $L_{28}$ of the second coil 102 have the spiral distribution in a vertical projecting direction. In addition, the first metallic lines $L_{11}$ to $L_{18}$ and the second metallic lines $L_{21}$ to $L_{28}$ are aligned on the same plane in a horizontal projecting direction, respectively.

As shown in FIGS. 1B and 1D, the magnetic element further includes a first electrode 112 and a second electrode 113. The first electrode 112 is electrically connected to one of the first metallic lines $L_{11}$ to $L_{18}$. In the embodiment, the first electrode 112 is electrically connected to the first metallic line $L_{11}$. The second electrode 113 is electrically connected to one of the second metallic lines $L_{21}$ to $L_{28}$, which is located at the inner side of the second coil 102. Herein, the inner side means the part close to the center of the second coil 102 so that the second electrode 113 is electrically connected to the second metallic line $L_{25}$. One end of the first electrode 112 connected to the first metallic line and one end of the second electrode 113 connected to the second metallic line are extended to opposite directions.

The magnetic element further includes a package body for enclosing the coil sets therein. The package body includes a first magnetic substrate, a second magnetic substrate and an intermediate layer disposed between the first and second magnetic substrates. The pair of coil sets are disposed in the intermediate layer. The intermediate layer includes a single or multiple dielectric layers or insulating layers 103 for separating the pair of coil sets. The coil sets and the first or second magnetic substrates are separated by the dielectric layer 103. The thickness of each dielectric layer or insulating layer ranges between 4 to 20 μm, and the thickness of the first and second coils ranges between 9 to 11 μm, respectively. The interval between the metallic lines ranges between 30 to 60 μm, and the width of each of the metallic lines ranges between 10 to 15 μm. Of course, the above-mentioned values can be adjusted according to the actual need. The conductive column can be formed by filling a conductive material in a conductive hole of the dielectric layer.

Figure 2A:
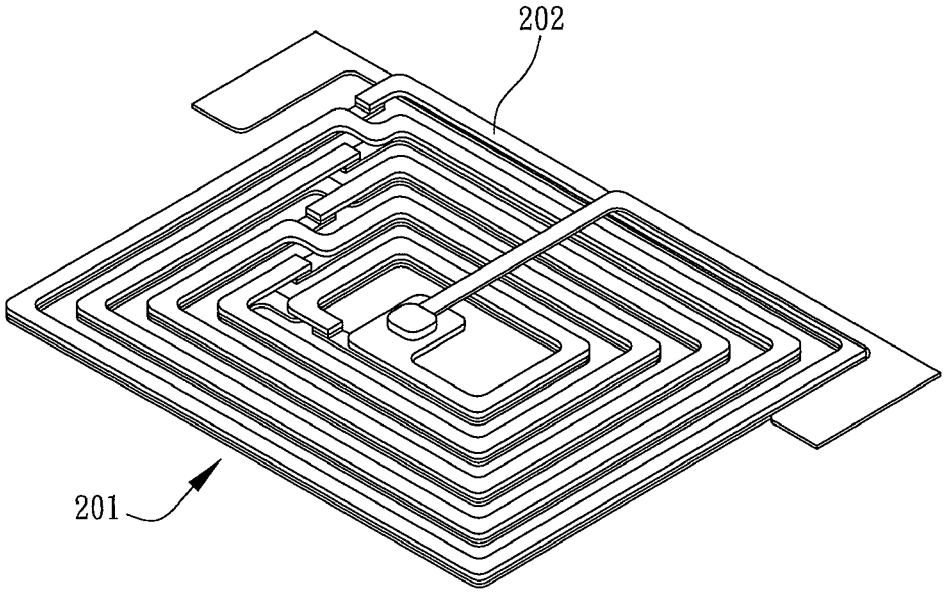
FIG. 2A is a schematic illustration showing a distribution of another coil set of the magnetic element according to the embodiment of the present invention.
Figure 2B:
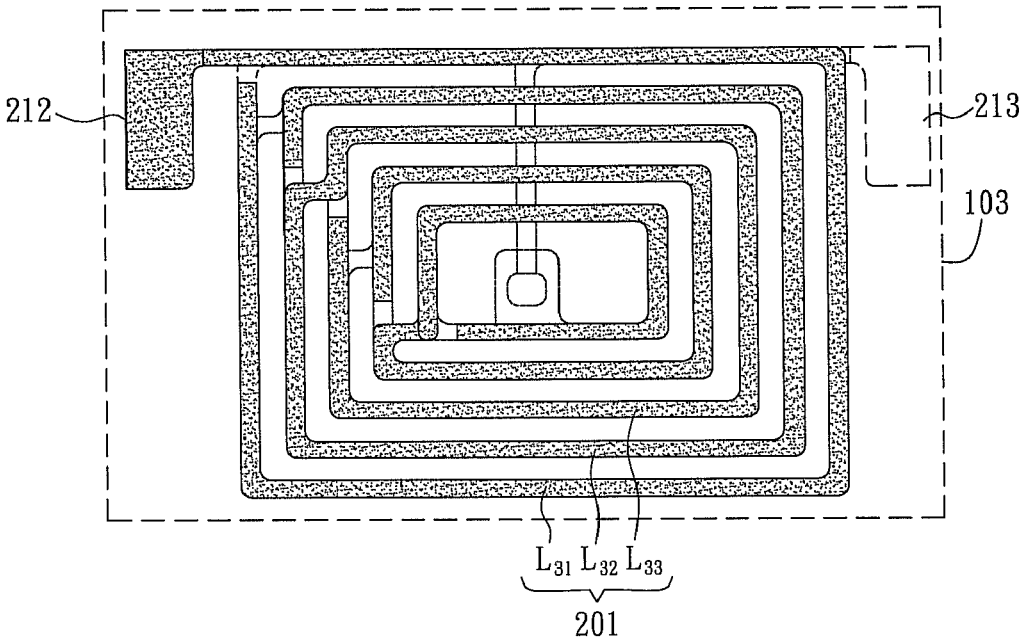
FIG. 2B is a schematic illustration of the first coil in FIG. 2A.
Figure 2C:
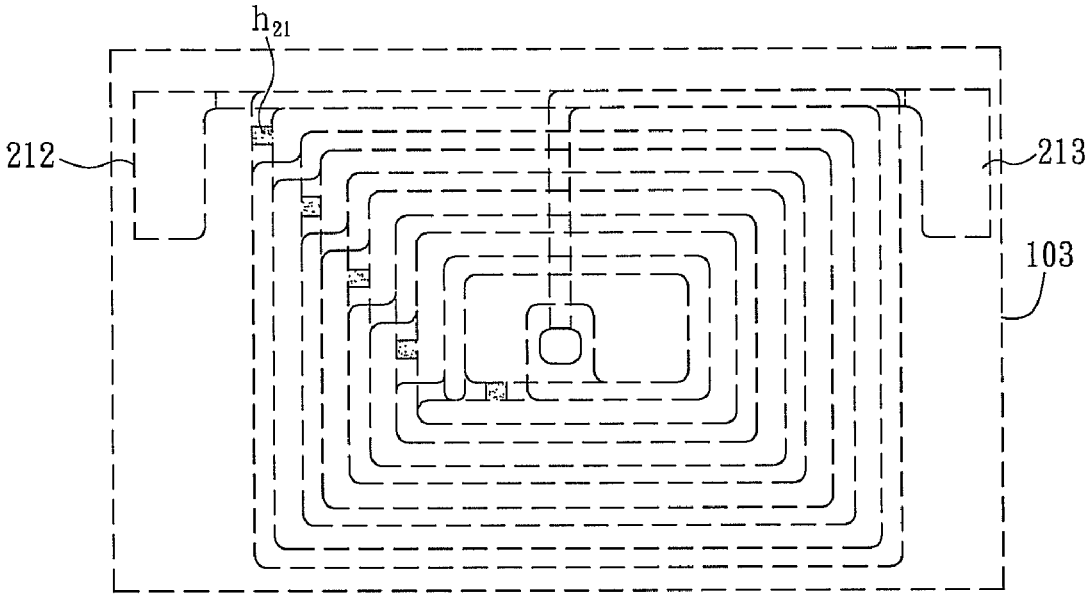
FIG. 2C is a schematic illustration showing the configuration of the conductive column for connecting the first coil and the second coil.
Figure 2D:
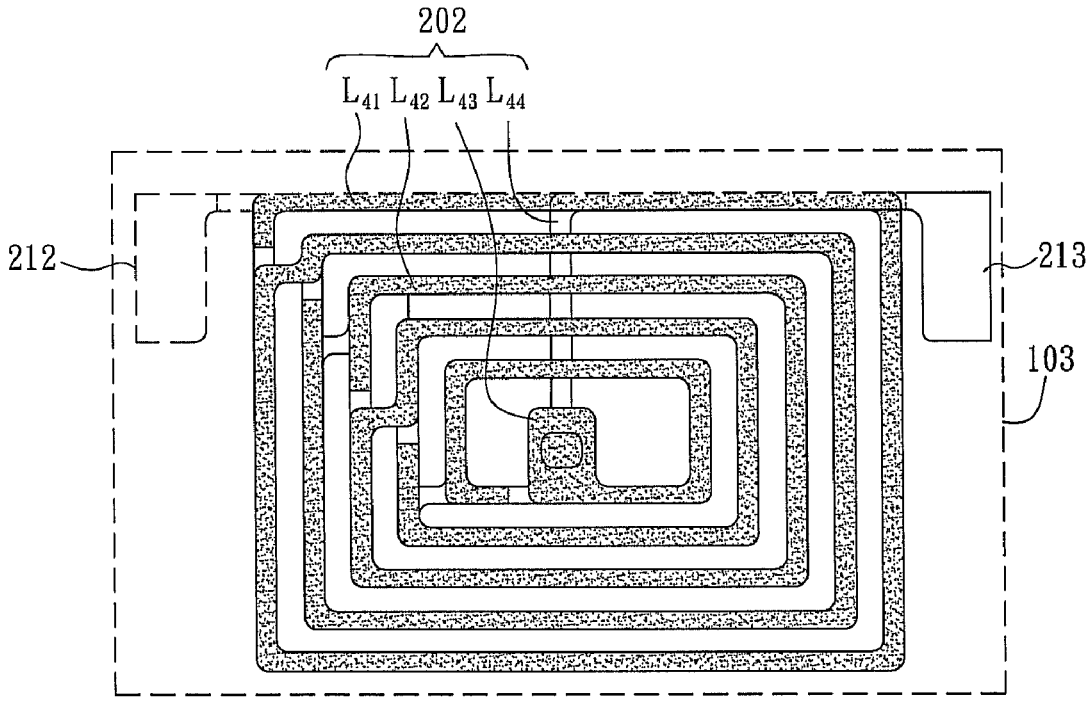
FIG. 2D is a schematic illustration showing the distribution of the second coil in FIG. 2A.

FIG. 2A is a schematic illustration showing a distribution of another coil set of the magnetic element according to the embodiment of the present invention. FIG. 2B is a schematic illustration of the first coil 201 in FIG. 2A. FIG. 2D is a schematic illustration showing the distribution of the second coil 202 in FIG. 2A. FIG. 2C is a schematic illustration showing the configuration of a conductive column $h_{21}$ for connecting the first and second coils 201, 202. The structure shown in FIGS. 2A to 2D is approximately the same as that of the previous embodiment, and will not be explicitly described herein, the description that follows being limited to the differences in this embodiment with respect to the previous embodiment. Specially, the first metallic lines $L_{31}$ to $L_{33}$ of the first coil 201 and the second metallic lines $L_{41}$ to $L_{43}$ of the second coil 202 are totally overlapped in the vertical projecting direction. In addition, one end of the first electrode 212 connected to the first metallic line $L_{31}$ and one end of the second electrode 213 connected to the second metallic line $L_{41}$ are extended to the same direction.

Figure 3A:
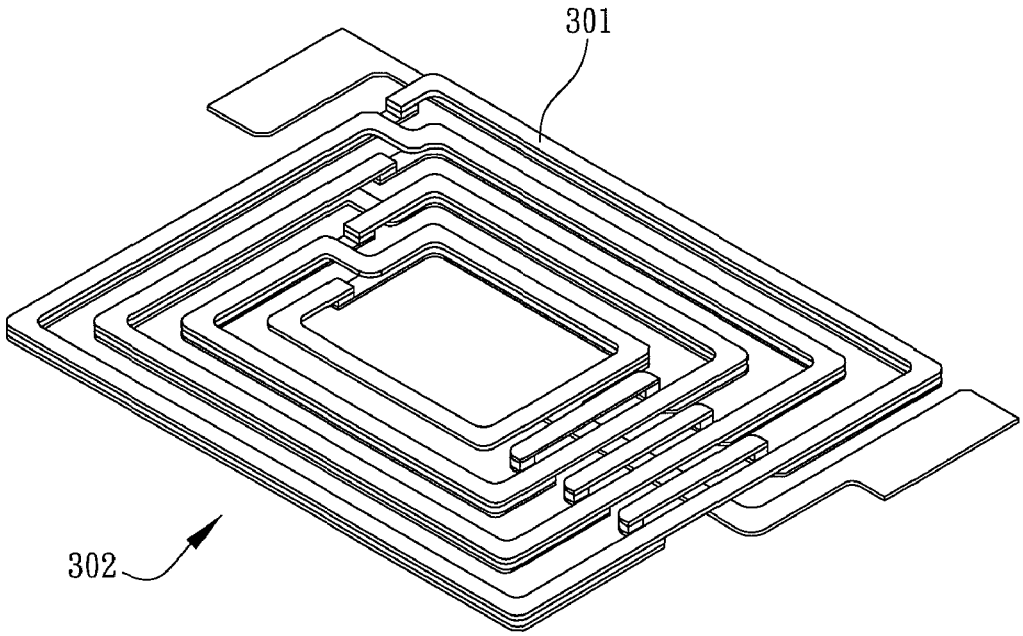
FIG. 3A is a schematic illustration showing a distribution of still another coil set of the magnetic element according to the embodiment of the present invention.
Figure 3B:
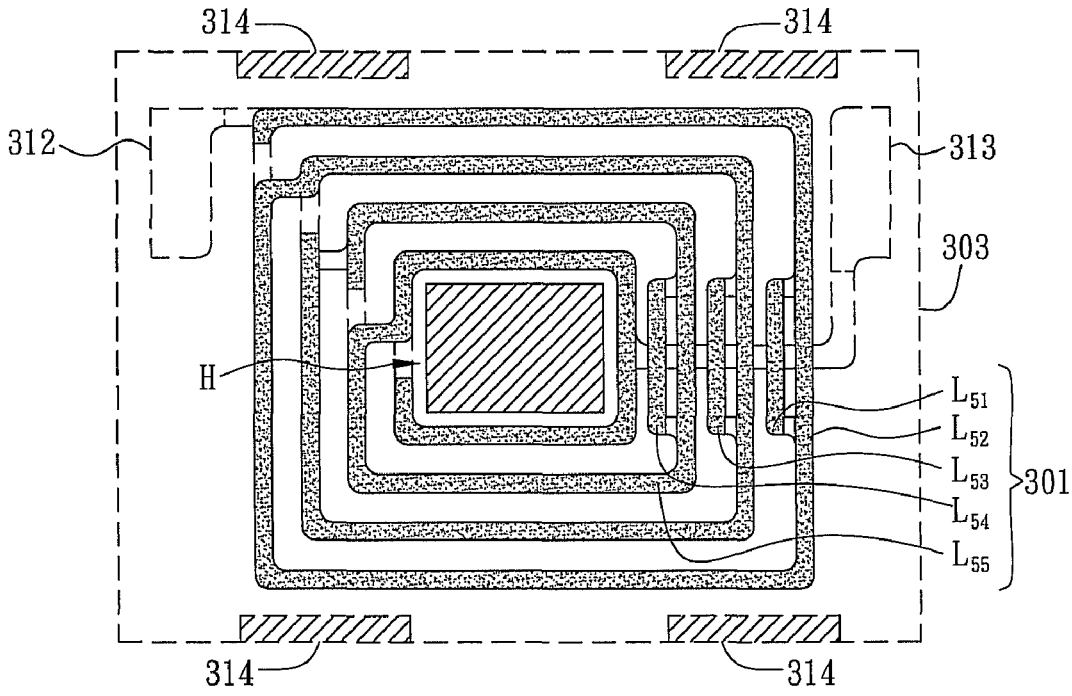
FIG. 3B is a schematic illustration of the first coil in FIG. 3A.
Figure 3C:
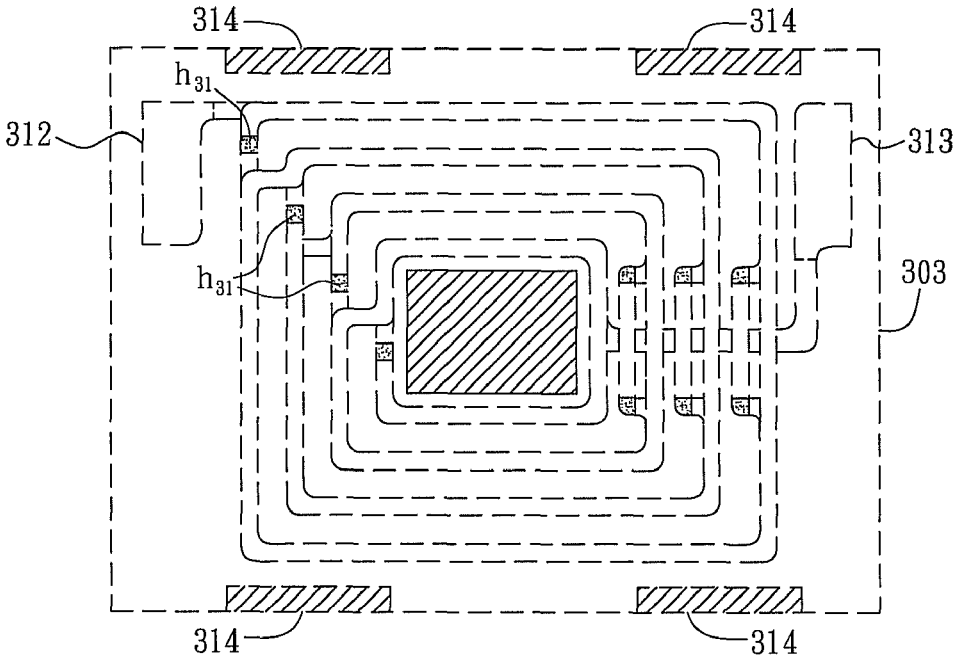
FIG. 3C is a schematic illustration showing the configuration of the conductive column for connecting the first coil and the second coil.
Figure 3D:
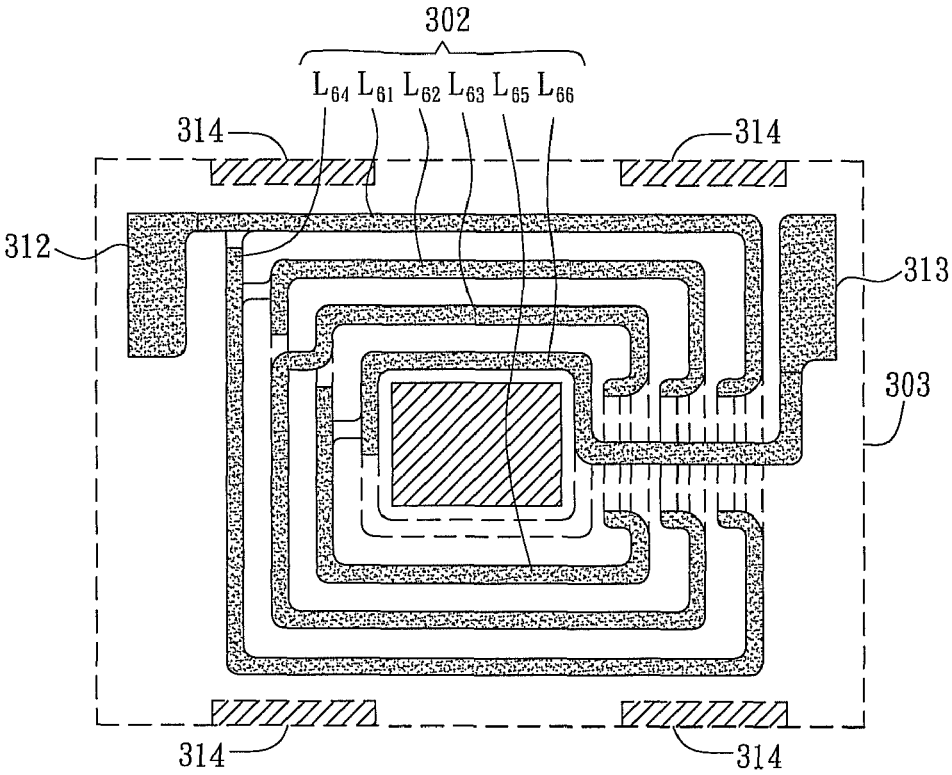
FIG. 3D is a schematic illustration showing the distribution of the second coil in FIG. 3A.

FIG. 3A is a schematic illustration showing a distribution of still another coil set of the magnetic element according to the embodiment of the present invention. FIG. 3B is a schematic illustration of the first coil 301 in FIG. 3A. FIG. 3D is a schematic illustration showing the distribution of the second coil 302 in FIG. 3A. FIG. 3C is a schematic illustration showing the configuration of a conductive column $h_{31}$ for connecting the first and second coils 301, 302. The structure shown in FIGS. 3A to 3D is approximately the same as that of the previous two embodiments, and will not be explicitly described herein, the description that follows being limited to the differences in this embodiment with respect to the previous two embodiments. Specially, the first metallic lines $L_{51}$ to $L_{55}$ of the first coil 301 and the second metallic lines $L_{61}$ to $L_{66}$ of the second coil 302 are partially overlapped in the projecting direction and are partially not overlapped in the vertical projecting direction.

In addition, the magnetic element further includes a magnetic material filled in a through hole H of the dielectric layer 303 and at least a side area 314 of the magnetic element as shown in FIGS. 3B to 3D. Thus, the inductance value of the magnetic element can be increased. The magnetic material includes the magnetic powder and resin.

The first electrode 312 is electrically connected to the second metallic line $L_{61}$, and the second electrode 313 is electrically connected to the second metallic line $L_{66}$. One end of the first electrode 312 connected to the second metallic line and one end of the second electrode 313 connected to the second metallic line are extended to opposite directions.

Figure 4A:
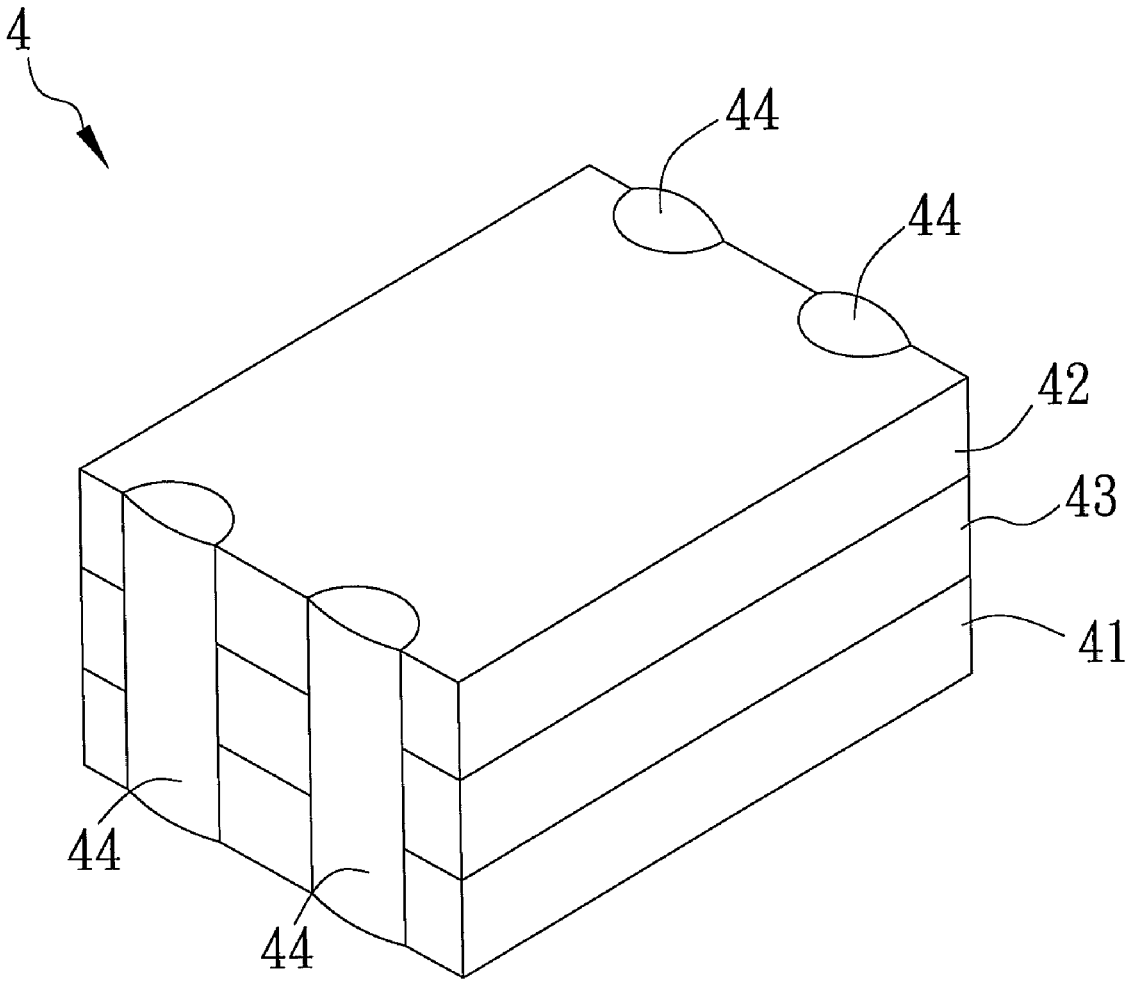
FIG. 4A is a three-dimensional diagram of the magnetic element of the present invention.
Figure 4B:
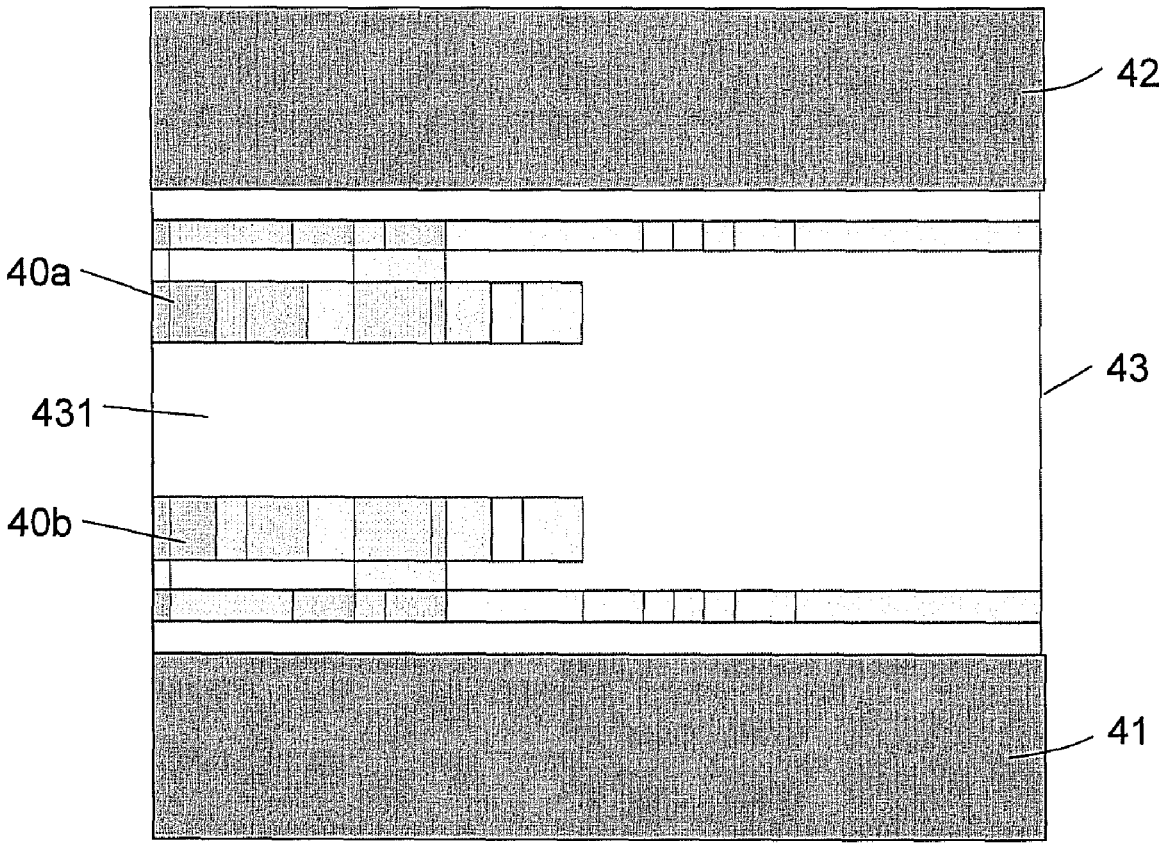
FIG. 4B is a sectional diagram of the magnetic element of the present invention.

FIG. 4A is a three-dimensional diagram of the magnetic element of the present invention, and FIG. 4B is a sectional diagram of the magnetic element of the present invention. As shown in FIGS. 4A and 4B, the magnetic element 4 includes two coil sets and a package body enclosing the coil sets. The package body includes a first magnetic substrate 41, a second magnetic substrate 42, an intermediate layer 43 and a plurality of external electrodes 44. Two coil sets 40*a* and 40*b*, which can be any one selected from those described in the above embodiments, are disposed in the intermediate layer 43. The coil sets 40*a* and 40*b* are separated by an insulating layer or a dielectric layer 431. In addition, the coil sets 40*a* and 40*b* are separated with the first magnetic substrate 41 and the second magnetic substrate 42 by an insulating layer or dielectric layer. The first and second electrodes of the coil sets 40*a* and 40*b* are electrically connected to four external electrodes 44, respectively. The external electrodes 44 can be formed by sputtering or electroplating.

In summary, the magnetic element of the present invention has the first and second coils, which have a spiral distribution. In addition, the first and second coils are connected by the conductive column, so that the layouts of the first and second coils can be totally overlapped, partially overlapped or not overlapped in the vertical projecting direction. Thus, the magnetic element of the present invention can be sufficiently minimized and have larger bandwidth or inductance value. In addition, the magnetic element of the present invention can be a filter for eliminating the CM noise.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A magnetic element comprising:

a pair of coil sets, each of which comprises:

a first coil having a plurality of first metallic lines, a second coil having a plurality of second metallic lines, and at least one conductive column electrically connected between the first and second coils; and a package body for enclosing the pair of coil sets therein, wherein the package body comprises a first magnetic substrate; a second magnetic substrate disposed opposite to the first magnetic substrate; and an intermediate layer disposed between the first and second magnetic substrates, wherein the pair of coil sets are embedded in the intermediate layer.

2. The magnetic element according to claim 1, wherein the first and second coils have a spiral distribution in a projecting direction.

3. The magnetic element according to claim 2, wherein the first metallic lines and a part of the second metallic lines are partially or totally overlapped in the projecting direction, or the first and second metallic lines are not overlapped in the projecting direction.

4. The magnetic element according to claim 1, wherein the first metallic lines or the second metallic lines are aligned on the same plane, respectively, in another projecting direction.

5. The magnetic element according to claim 1, wherein the thickness of the first or second coil ranges between 9 to 11 μm.

6. The magnetic element according to claim 1, wherein an interval between the metallic lines ranges between 30 to 60 μm, and the width of the metallic lines ranges between 10 to 15 μm.

7. The magnetic element according to claim 1, wherein the intermediate layer comprises at least one dielectric layer or insulating layer and has at least one through hole, and a magnetic material is filled in the through hole or a side area of the magnetic element.

8. The magnetic element according to claim 7, wherein the magnetic material comprises a magnetic power and a resin.

9. The magnetic element according to claim 7, wherein the dielectric layer or the insulating layer has at least one conductive hole, and a conductive material is filled in the conductive hole for forming the conductive column.

10. The magnetic element according to claim 1, wherein the intermediate layer comprises a single or multiple dielectric layers or insulating layers.

11. The magnetic element according to claim 10, wherein the thickness of each of the dielectric layers or insulating layers ranges between 4 to 20 μm.

12. The magnetic element according to claim 1, wherein the pair of coil sets and the first or second magnetic substrate are separated by an insulating layer or a dielectric layer.

13. The magnetic element according to claim 1, further comprising a first electrode electrically connected to one of the first metallic lines, and a second electrode electrically connected to one of the second metallic lines.

14. The magnetic element according to claim 13, wherein one end of the first electrode connected to the first metallic line and one end of the second electrode connected to the second metallic line are extended to opposite or the same direction.

15. The magnetic element according to claim 13, further comprising a plurality of external electrodes electrically connected to the first and second electrodes.

16. The magnetic element according to claim 15, wherein the external electrode is formed by sputtering or electroplating.

17. The magnetic element according to claim 1, wherein the pair of coil sets are separated by an insulating layer or a dielectric layer.

18. The magnetic element according to claim 1 being a filter for eliminating a common-mode noise.

19. A magnetic element comprising:

a first coil having a plurality of first metallic lines;

a second coil having a plurality of second metallic lines;

at least one conductive column connected between the first and second coils, wherein the first and second coils have a spiral distribution, and the first and second metallic lines are partially overlapped, totally overlapped or not overlapped in a projecting direction; and a first electrode electrically connected to an end of one of the first metallic lines, and a second electrode electrically connected to an end of one of the second metallic lines, wherein the first and second electrodes are electrically connected to a plurality of external electrodes, respectively.

20. The magnetic element according to claim 19, further comprising:

a first magnetic substrate;

a second magnetic substrate disposed opposite to the first magnetic substrate; and an intermediate layer disposed between the first and second magnetic substrates, wherein the first and second coils are disposed in the intermediate layer.

* * * * *